US008317122B2

(12) United States Patent
Thepaut

(10) Patent No.: US 8,317,122 B2
(45) Date of Patent: Nov. 27, 2012

(54) DEVICE AND METHOD FOR PREPARING MANDRELS, DEVICE FOR COLLECTING THE WOUND MANDRELS AND DEVICE AND METHOD FOR HANDLING THE MANDRELS

(75) Inventor: Frederic Thepaut, Saint Philbert de Granlieu (FR)

(73) Assignee: Armor, Nantes (FR)

( * ) Notice: Subject to any disclaimer, the term of this patent is extended or adjusted under 35 U.S.C. 154(b) by 288 days.

(21) Appl. No.: 12/920,482

(22) PCT Filed: Mar. 9, 2009

(86) PCT No.: PCT/FR2009/050374
§ 371 (c)(1),
(2), (4) Date: Sep. 1, 2010

(87) PCT Pub. No.: WO2009/115748
PCT Pub. Date: Sep. 24, 2009

(65) Prior Publication Data

US 2011/0011971 A1 Jan. 20, 2011

(30) Foreign Application Priority Data

Mar. 12, 2008 (FR) ..... 08 01351

(51) Int. Cl.
*B65H 67/04* (2006.01)
*B65H 19/30* (2006.01)

(52) U.S. Cl. ..... 242/473.5; 242/533

(58) Field of Classification Search ..... 242/473.4, 242/473.5, 473.9, 533, 533.1, 533.7
See application file for complete search history.

(56) References Cited

U.S. PATENT DOCUMENTS

| | | | |
|---|---|---|---|
| 1,302,280 | A | 4/1919 | Batchelder |
| 2,493,590 | A | 1/1950 | Mueller et al. |
| 5,941,474 | A | 8/1999 | Cushing |

FOREIGN PATENT DOCUMENTS

| | | | |
|---|---|---|---|
| DE | 197 01 315 | A1 | 7/1997 |
| WO | 2005/023694 | A1 | 3/2005 |

OTHER PUBLICATIONS

International Search Report, dated Aug. 31, 2009, from corresponding PCT application.

*Primary Examiner* — William E Dondero
(74) *Attorney, Agent, or Firm* — Young & Thompson

(57) ABSTRACT

A device and a method for preparing mandrels (1') to be fitted on a rod (7) and spaced from one another. The device includes two grooves (2, 3) arranged in the vicinity of one another, i.e. a supply groove for receiving the mandrels (1) along the axis of the groove, the groove being combined with elements for juxtaposing the mandrels, and a groove for receiving the mandrels selected from the mandrels of the supply groove, the receiving groove being fitted with abutment members (6) for defining individual housings (18) for the selected mandrels, and an element (5) for transferring the selected mandrels towards the housings. A device for collecting coiled mandrels, and a device and method for handling the mandrels are also described.

17 Claims, 9 Drawing Sheets

26
1'
1'
1'

DEVICE AND METHOD FOR PREPARING MANDRELS, DEVICE FOR COLLECTING THE WOUND MANDRELS AND DEVICE AND METHOD FOR HANDLING THE MANDRELS

The present invention relates generally to the winding of mandrels.

More particularly, the invention relates to a device and method for preparing mandrels to be fitted onto a rod and spaced apart from one another. The invention also relates to a device for collecting the wound mandrels and to a device and method for handling said mandrels.

Devices are known from the prior art for preparing mandrels which take the form of a table equipped with a groove into which the operator inserts the mandrels and in which he aligns them one after the other, depending on their desired position on the rod. The operator then fits the rod through the aligned mandrels, along their axis. Such a preparation table allows several mandrels to be fitted onto the same rod and, once the rod has been inserted into a winding machine, the mandrels then to be wound simultaneously. However, the mandrels are inserted into the table one by one, which slows down the operation of preparing the mandrels. Furthermore, the positioning of the mandrels is inaccurate and may lead to errors.

U.S. Pat. No. 2,493,590 and U.S. Pat. No. 5,941,474 describe devices for preparing a set of mandrels in which the latter are stored in compartmentalized containers placed opposite the desired positions for the mandrels on the rod.

These devices in particular do not allow for much flexibility in the size of the mandrels as the walls of the compartments must be modified when the length of the mandrels is changed.

Robots are also known that are designed to automatically grasp a mandrel, position it in a winding machine and then extract it from said machine once it has been wound. Such a robot allows the operation of winding said mandrel to be automated. However, the robot can only manipulate one mandrel or one reel at a time. Moreover, without significantly increasing the manufacturing cost of the robot, such robots are incapable of manipulating successively mandrels of different lengths.

The object of the present invention is to allow a plurality of mandrels to be placed quickly and accurately on the same rod in their desired relative positions.

A further object of the present invention is to allow reels with mandrels of different lengths to be made easily and quickly.

A further object of the present invention is to limit the risk of error in the positioning of the mandrels on the rod.

To this end, the invention relates to a device for preparing a set of mandrels to be fitted onto a rod and spaced apart from one another, characterized in that said device comprising at least two grooves arranged in proximity to one another, namely:

on the one hand, a supply groove for receiving the mandrels 1 aligned along the axis of said groove and juxtaposed via their end face, said groove being associated with means for juxtaposing said aligned mandrels, the means for juxtaposing the mandrels arranged in the supply groove comprising a device for conveying the mandrels along the supply groove, said device being associated with an abutment at one end of the groove for immobilizing axially the mandrels aligned in said groove in a juxtaposed position, and, on the other hand, a groove for receiving mandrels selected from the aligned mandrels the supply groove, said receiving groove being equipped with abutment members that can be positioned in said receiving groove along the axis of said groove in order to define individual housings for receiving the selected mandrels, the device also comprising means for transferring the selected mandrels from the supply groove toward said individual receiving housings.

Such a preparation device allows a plurality of mandrels to be positioned on the rod. After they have been fitted on a rod, these mandrels can thus be wound simultaneously. The preparation device according to the invention thus allows an increased rate of production of reels. Furthermore, such a device is capable of preparing mandrels of different sizes simply by modifying the position of the abutment members in the receiving groove.

The mandrels can be easily and quickly positioned in the receiving groove, spaced apart from one another in accordance with their desired position on the rod. Indeed, the use of a mandrel supply groove allows a supply of mandrels to be held advantageously in proximity to the receiving groove. The selected mandrels can then be quickly transferred into the housings of the receiving groove with a view to the mandrels being fitted onto the rod.

The means for juxtaposing the mandrels make it possible to obtain a continuous line of mandrels juxtaposed via their end face and hence aligned along their axis. Because of such a juxtaposition of mandrels in the supply groove, it is easy to determine the position of each of the mandrels. It is thus possible to select the mandrels from the supply groove, positioned opposite the individual housings of the receiving groove, which permits easy and quick transfer of said mandrels into said housings.

The combined use of a mandrel supply groove in proximity to the receiving groove and means for transferring the mandrels makes it possible to transfer the selected mandrels simultaneously from the supply groove toward the receiving groove and into the housings formed by the abutment members, which makes it possible to achieve a high production rate.

For a given preparation cycle for a set of mandrels, the mandrels fitted onto the rod preferably have the same length. As a variant, for a given mandrel preparation cycle, it can be envisaged that the lengths of the mandrels on the rod are different from one mandrel to another. It can also be envisaged that the mandrels have different lengths from one preparation cycle to another. In each case, the position of the abutment members along the receiving groove is adjusted in order to define individual housings in accordance with the desired mutual relative position of the mandrels. Once the positions of the mandrels along the supply groove are known, the transfer means can easily transfer the selected mandrels into said receiving housings.

The rod can then be fitted, via one end of the receiving groove, through the hollow axis of the aligned mandrels spaced apart from one another, in a direction of fitting that corresponds to the direction of displacement of the mandrels abutting against the abutment members. The selected mandrels can thus all be immobilized from the same side, which allows the rod to be fitted reliably and accurately through the mandrels whilst preserving the desired mutual relative positions and with reference to the rod.

According to an advantageous feature of the invention, means are provided for determining the position at which each abutment member must be arranged along the receiving groove in order to form said individual housings for receiving the selected mandrels, each position being determined at least as a function of the length and/or the number of the mandrels to be mounted on the rod. The use of such determining means makes it possible to automate the device for preparing the set of mandrels.

The combination of an abutment and the conveying device allows the juxtaposed and aligned mandrels to be held in the supply groove. Indeed the mandrels retained by the abutment are pushed against one another by the conveying device. Once the position of the end abutment and the length of the mandrels are known, the position of each of the mandrels arranged along the supply groove is known accurately.

According to an advantageous feature of the invention, the receiving groove is equipped with a device for axially displacing the received mandrels in order to bring them into abutment, within the receiving groove, with the corresponding abutment members positioned in said groove.

Once the selected mandrels have been transferred into the individual housings of the receiving groove, the axial displacement device allows said selected mandrels to be brought into abutment with said abutment members. The mandrels brought into abutment are thus accurately and stably positioned in the receiving groove according to their desired relative position so that they can be fitted onto the rod. The axial displacement device thus makes it possible to eliminate the play that exists between the mandrels and the abutment members after said mandrels have been transferred into the housings.

According to an advantageous feature of the invention, said means for transferring the selected mandrels comprise radial pushing members that are intended to be brought to bear, via a pushing end, against the peripheral wall of the selected mandrels, it being possible for said pushing members to be moved between a starting position in which said members are retracted from the supply groove and a final position in which the pushing end of said members is arranged at right angles to the receiving groove, the position of each pushing member preferably being axially adjustable with reference to the selected mandrels to be transferred.

Because the supply groove and the receiving groove are arranged in proximity to each other, the use of pushing members allows said selected mandrels to be transferred easily from the supply groove toward the corresponding housings of the receiving groove. The possibility of adjusting the position of the pushing members along the axis of the supply groove allows them to be positioned opposite the selected mandrels so that the latter can be transferred. This adjustability is particularly advantageous when the lengths of the mandrels vary from one mandrel to another, or alternatively when the lengths of the mandrels differ from one mandrel preparation cycle to another.

According to an advantageous feature of the invention, means are provided for aiding the positioning of the abutment members along the axis of the receiving groove. The means for aiding the positioning preferably comprise at least one element that extends parallel to the axis of the receiving groove and is equipped with teeth, in the manner of a rack, that can interact with corresponding teeth arranged on the distal end of each of the abutment members positioned along the axis of the receiving groove.

Each tooth of an element of the means for aiding the positioning constitutes a step for positioning the abutment member along the axis of the receiving groove. The stepped positioning of the abutment members makes it possible to achieve accurate, stable and reproducible location of the abutment members.

In order to increase the number of positions that the abutment members can assume along the receiving groove, two elements for aiding positioning are preferably provided, the teeth of the first element being offset relative to the teeth of the second element. A tooth width of, for example, two millimeters, makes it possible to choose the positioning of the abutment members in one-millimeter steps, with an initial positioning error of less than two millimeters. A robot can thus be used to place the abutment members, with a degree of accuracy that can be as high as slightly less than two millimeters, it still being possible to position the abutment member in one-millimeter steps. It is thus possible to use a less expensive robot.

According to an advantageous feature of the invention, each axial abutment member positioned along the axis of the receiving groove extends substantially perpendicularly to the supply groove to form a radial abutment for the unselected mandrels, so that said unselected mandrels are retained in the supply groove.

The abutment members thus combine several functions, which makes it possible to limit the size of the preparation device and reduce its cost.

According to an advantageous feature of the invention, the device comprises at least one element, such as a plate, for covering the mandrels housed in the receiving groove, said or each covering element being displaceable between a position in which it at least partially covers said groove in order to hold said mandrels inside the receiving groove and a position in which said groove is uncovered.

The covering element thus forms a cover that is used when the rod is fitted into the mandrels to form an upper barrier to prevent the mandrels from escaping from their housing. It can be provided that the covering means take the form of a single covering element that extends over the entire length of the receiving groove. As a variant, it can be provided that the covering means take the form of a plurality of covering elements that each extend, for example, along a portion of the receiving groove with a view to covering the individual housings of the mandrels.

According to an advantageous feature of the invention, the device comprises means for checking the positioning of each mandrel along the rod, the checking means preferably comprising a device for capturing images, such as a camera, and image-processing software.

The invention also relates to a handling device which comprises, on the one hand, a device for preparing empty mandrels as described above with a view to them being fitted onto a rod and, on the other hand, a device for collecting full mandrels known as reels and carried by the rod with a view to them being removed from the rod, said device comprising a preferably V-shaped groove for receiving the reels in individual housings for reels defined by axial abutment members, it being possible to adjust the position of each abutment member along said reel-receiving groove in order to define said individual housings for reels, with an axial length substantially equal to that of the individual housings for mandrels of the receiving groove of said preparation device.

Like the mandrel-receiving groove, the reel-receiving groove thus comprises abutment members which are positioned to form housings capable of receiving the full mandrels or reels, and to retain said full mandrels in their housing. After the rod has been extracted, the reels thus maintain an accurate position abutting said abutment members of the reels.

The V-shaped groove allows reels of different diameters to be received, which makes the device adaptable to different winding lengths on the mandrels, resulting in varying thicknesses.

According to an advantageous feature of the invention, means are provided for holding the abutment members for the reels in position in the receiving groove for the reels.

According to an advantageous feature of the invention, means are provided for aiding the positioning of the abutment members of the reels along the axis of the receiving groove for the reels. The means for aiding the positioning preferably comprise at least one element that extends parallel to the axis of the receiving groove for the reels and is equipped with teeth, in the manner of a rack, that can interact with corresponding teeth arranged on each of the abutment members positioned along the axis of the receiving groove for the reels.

The invention also relates to a method for preparing mandrels to be fitted on a rod and spaced apart from one another, which comprises the steps of:

a) positioning, along a groove for receiving the mandrels, abutment members for defining individual housings for receiving the mandrels to be fitted, each abutment member being positioned as a function of the desired position of said mandrels on the rod, b) bringing, by means of a conveying device, a series of aligned mandrels juxtaposed via their end face into a supply groove arranged in proximity to the receiving groove for the mandrels, the order of steps a) and b) being interchangeable, c) transferring, preferably simultaneously, the mandrels to be fitted from the supply groove toward the receiving groove, into said individual mandrel housings, d) axial displacement of the mandrels transferred into the individual housings of the receiving groove in order to bring them into abutment with the abutment members.

Before steps a) or b), the number of the abutment members to be positioned in the receiving groove, and their axial position along said groove are preferably determined at least as a function of the length and/or the number of mandrels to be mounted on the rod.

The invention also relates to a method for handling mandrels comprising the steps for preparing the empty mandrels as described above and the following steps of:

e) fitting empty mandrels, housed in the receiving groove for the mandrels, onto a rod and then transferring the rod into a winding area, f) winding onto the mandrels fitted onto the rod to form reels, g) depositing the reels carried by the rod in individual reel housings defined by abutment members positioned beforehand in a receiving groove for the reels, the position of each abutment member being adjusted along said receiving groove for the reels to define said individual housings for the reels, h) removal of the rod by axial displacement of the reels, said reels remaining in place in said individual reel housings.

The invention may be understood by reading the following description of embodiments with reference to the attached drawings in which.

With reference to the figures and as mentioned above, the invention relates to a handling device which comprises, on the one hand, a device for preparing a set of empty mandrels 1' with a view to them being fitted onto a rod 7 and, on the other hand, a device for collecting the full mandrels known as reels 16, carried by the rod 7 with a view to them being removed from the rod.

The reels 16 are obtained by winding a material, in the form of a tape, around mandrels 1' carried by the rod 7 with the aid of a winding machine into which is fitted said rod 7 carrying the mandrels 1' fitted onto said rod. The mandrels are hollow tubes made, for example, from plastic, cardboard or metal.

In the example illustrated in the figures, the handling device and the associated method are applied to mandrels around which are wound heat transfer tapes. As a variant, it is possible to envisage that other elements such as filament, film, paper or other types of tape are wound around the mandrels.

Device for Preparing Mandrels

The mandrels 1' prepared by the device for preparing mandrels are intended to be fitted onto a rod 7, separated from one another in accurate desired relative positions.

Figure 1:
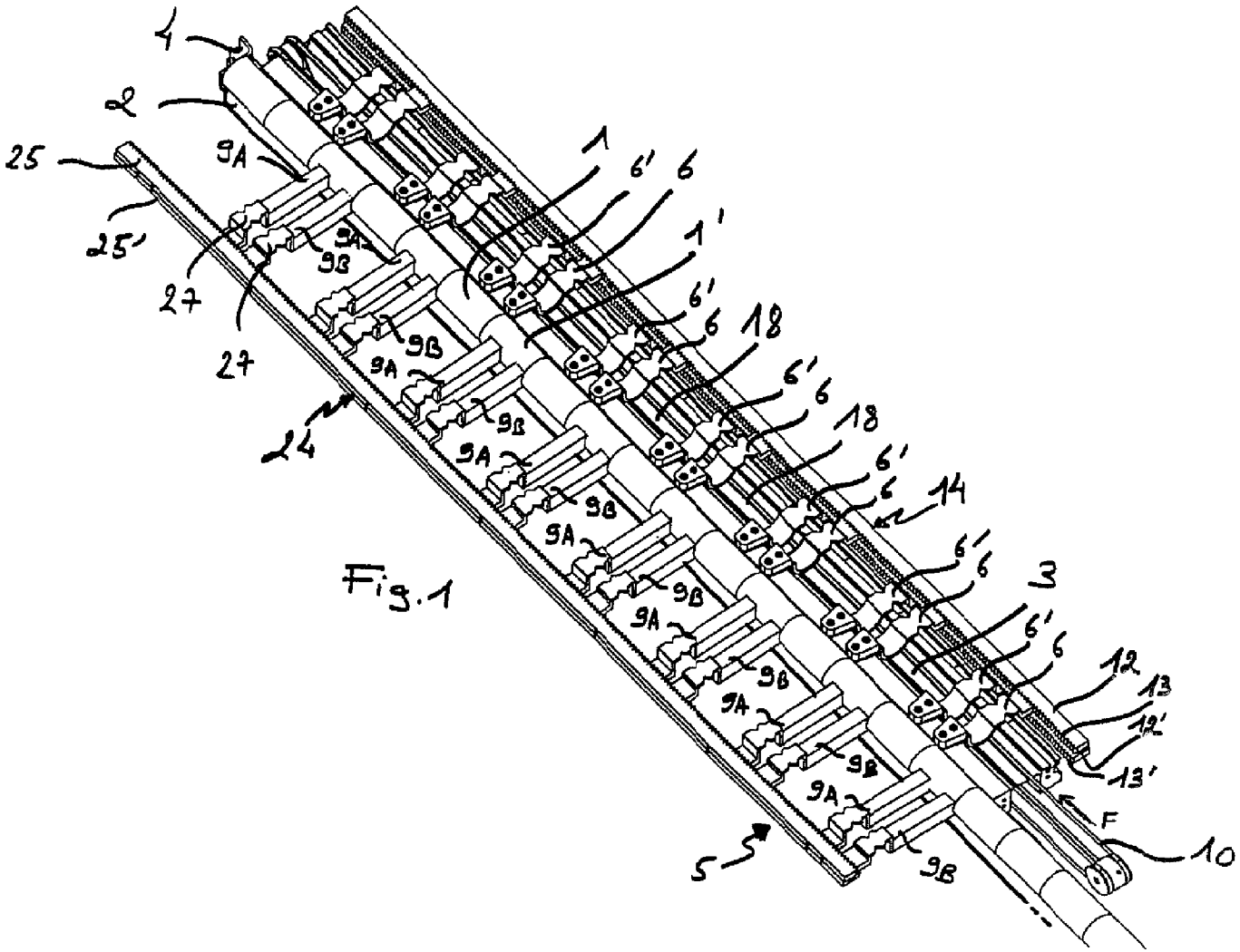
FIG. 1 is a perspective view of the preparation device according to the invention.
Figure 2:
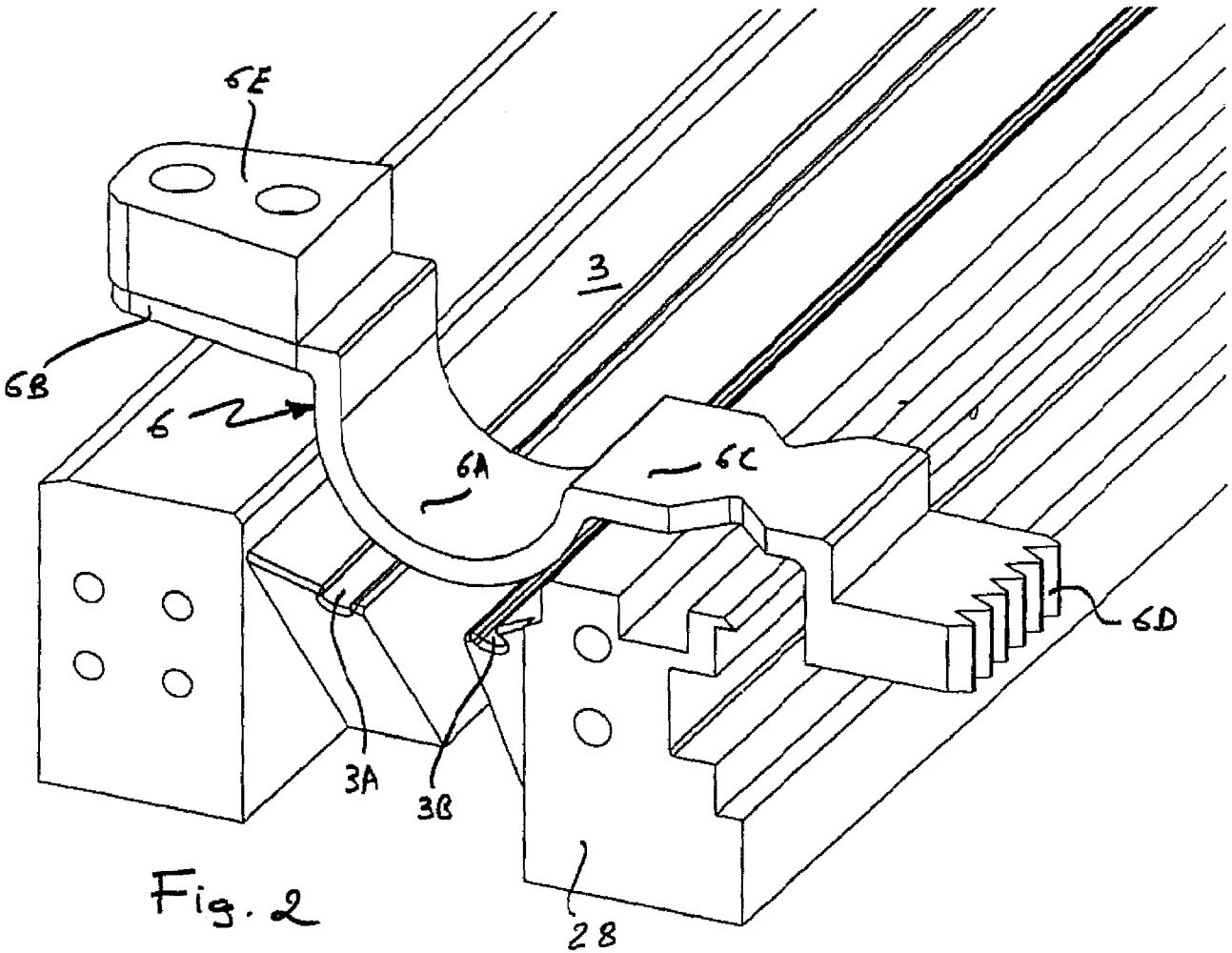
FIG. 2 is a detailed perspective view of a mandrel abutment member arranged in the receiving groove of the preparation device in FIG. 1.

As illustrated in FIGS. 1 and 2 and as characterized by the invention, said preparation device comprises two grooves 2, 3 arranged in proximity to each other, namely, on the one hand, a supply groove 2 (FIG. 1) for receiving mandrels 1 aligned in the axis of said groove 2, said groove 2 being associated with means for juxtaposing said aligned mandrels 1 and, on the other hand, a groove 3 for receiving mandrels 1' selected from the mandrels 1 of the supply groove 2. Said receiving groove 3 is equipped with abutment members 6, 6' which can be positioned in said receiving groove 3 along the axis of said groove 3 to define individual housings 18 for receiving the selected mandrels 1'. The preparation device also comprises means 5 for transferring the selected mandrels 1' from the supply groove 2 toward said individual receiving housings 18.

As illustrated in FIG. 1, the two grooves 2, 3 are substantially parallel. To make the drawings clearer, grooves 2 and 3 have not been shown in FIGS. 3 to 5.

The preparation device preferably comprises means for determining the position in which each abutment member 6,6' must be arranged along the receiving groove 3, in order to form said individual housings 18 for receiving the selected mandrels. The determining means are formed, for example, by an electronic and data-processing unit which comprises data capture means, means for memorizing said data and means for communicating with a robot or any other automatic positioning device. Data such as the length of the mandrels can be memorized in the electronic and data-processing unit in order to determine automatically the optimal distribution of said mandrels on the rod and thus the relative mutual position of the mandrels. Determining the positions that the mandrels must take on the rod then allows the positions to be determined that the abutment members must take along the receiving groove in order to define the housings capable of receiving and of securing the mandrels in abutment in their desired position. The abutment members can then be positioned automatically along the receiving groove in their determined position.

A certain gap between the mandrels is envisaged in order to allow correct winding of the mandrels arranged on the same rod, the winding of all the mandrels preferably being carried out simultaneously.

Determining the positions that the mandrels 1' must take on the rod makes it possible to select some of the mandrels arranged in the supply groove 2 so that they can be transferred into the individual housings 18. In the example illustrated in the figures, the selected mandrels 1' are those which are situated opposite the housings 18 defined by the abutment members 6, 6'. As detailed below, the operation of selecting said mandrels is performed by positioning the transfer means opposite said mandrels.

Each axial abutment member 6, 6' positioned along the axis of the receiving groove 3 also extends substantially perpendicularly to the supply groove 2 to also form a radial abutment for the unselected mandrels so as to retain said unselected mandrels in the supply groove 2.

The means for juxtaposing the mandrels 1 arranged in the supply groove 2 comprise a device (not shown) for conveying the mandrels along the supply groove 2, said device being associated with an abutment 4 at the end of the groove 2 for retaining the mandrels 1 aligned in said groove 2 in a juxtaposed position. The conveying device preferably comprises two parallel vertical loops formed by two belts running inside and along the supply groove 2.

The receiving groove 3 is also equipped with a device 10 for axially displacing the transferred mandrels 1' in order to bring them into abutment with the members 6 positioned in the receiving groove 3. As illustrated in FIG. 1, the axial displacement device 10 takes the form of a conveying device that comprises two parallel vertical loops formed by two belts running inside and along the supply groove 3 in order to displace the selected mandrels 1' in the same direction against the abutment members 6 in order to accurately obtain their desired mutual relative positions.

As illustrated in FIG. 2, the receiving groove 3 is formed by two elongated bodies which extend parallel to each other and the upper faces of which are inclined so as to converge with each other to define said groove 3. As the two elongated bodies are not joined together, the groove 3 is open at its centre. The mandrels rest in the groove 3 on the belts of the conveying device 10 which run along slots 3A, 3B made in the elongated bodies forming the receiving groove 3.

The device comprises means 14 for aiding the positioning of the abutment members 6 along the axis of the receiving groove 3. These aiding means 14 comprise two superposed elongated elements 12, 12' which extend along the receiving groove 3 and which are provided with teeth 13, 13' in the manner of a rack. The element 12 is positioned above the element 12' and the teeth 13 of the element 12 are set back from the teeth 13' of the element 12' relative to the receiving groove 3. The teeth 13, 13' of a same element 12, 12' preferably have the same geometrical shape, in this case triangular, and are in the example shown spaced apart from one another by two millimeters. In other words, the width of each tooth defined by the base of its triangular shape is two millimeters. The teeth 13 of the element 12 are furthermore offset axially relative to the teeth 13' of the element 12' by a length of one millimeter. Such a geometrical configuration of the two elongated elements 12, 12' and their teeth makes it possible to position an abutment member in one-millimeter steps despite an initial positioning error that can be as much as slightly less than two millimeters. The teeth 13, 13' also form means for locking these abutment members in position.

As illustrated in more detail in FIG. 2, the abutment member 6 extends transversely to the axis of the receiving groove 3. The abutment member 6 comprises a central part 6A in the arc of circle through which the rod 7 can pass when said rod is fitted into the mandrels. This central part 6A rests inside the receiving groove 3 and with one of its sides, in this case the side visible in FIG. 2, forms an axial abutment with respect to the mandrel 1' to be housed in the corresponding individual housing 18. The central part 6A is extended on one side by an end part 6B forming, as explained above, a radial abutment with respect to the unselected mandrels remaining in the supply groove 2 for the mandrels. This part 6B also serves as a support for a raised element 6E to prevent an unselected mandrel from the supply groove from overlapping the part 6B of the abutment member 6. The other side of the central part 6A is extended by a straight part 6C which bears on a profile 28 that borders the receiving groove. The part 6C is itself extended by a toothed end part 6D, the teeth of which are intended to interact with the teeth 13 of the element 12 of the means 14 for aiding the positioning. In the example shown in the figures, the shape of the central part 6A which serves as an axial abutment is semi-circular. As a variant, the central part 6A can take other shapes, as long as said shape permits the passage of the rod to fit the rod onto said mandrels and provides a sufficient surface area for axial abutment. The abutment member 6' differs from the abutment member 6 only in its toothed end part which is designed to come into a position opposite the teeth 13' of the lower element 12' and engage with them.

The two elements 12, 12' are displaced integrally and mounted so that they can move radially with respect to the axis of the receiving groove 3 so as to eliminate the play between the teeth of the elements 13, 13' and the teeth of the abutment members 6 and 6', once the abutment members have been positioned in the groove 3. Such a design of the elements 12, 12' of the means 14 for aiding the positioning allows the abutment members to be positioned accurately and stably in said receiving groove.

The means 5 for transferring the selected mandrels 1' comprise pairs of radial-pushing members 9A, 9B intended to be applied, via a pushing end, against the peripheral wall of the selected mandrels 1' arranged in the supply groove 2. Said pushing members 9A, 9B can be moved between a starting position in which said members are retracted from the supply groove 2 and a final position in which the pushing end of said members is arranged at right angles to the receiving groove 3. In the example illustrated in the figures, the pushing members 9A, 9B are formed by parallelepipedal metal pins.

In the example illustrated in the figures, the position of each pushing member 9A, 9B can advantageously be adjusted axially to bring them opposite the selected mandrels 1' to be transferred.

The pushing members 9A, 9B are positioned opposite the selected mandrels 1' from the supply groove 2 in order to transfer them into the housings 18 of the receiving groove 3. In order to position the pushing members 9A, 9B accurately, similar to the means 14 for aiding the positioning of the abutment members 6, 6', means 24 for aiding the positioning are provided which are formed here by two superposed elongated elements 25, 25' that extend along the axis of the supply groove 2.

As illustrated in FIG. 1, these elongated elements 25, 25' are provided with teeth, in the manner of racks, that are intended to interact with teeth of the distal ends of the pushing members 9A, 9B. Two types of pushing members 9A and 9B are provided. A pair formed by a pushing member 9A and a pushing member 9B is positioned opposite each mandrel 1' to be transferred into the housing 18. Each pushing member 9B is capable of interacting with the teeth of the upper element 25 and each pushing member 9A is capable of interacting with the teeth of the other lower element 25'. The elements 25, 25' for aiding the positioning of the pushing members can be moved transversely to the axes of the grooves 2, 3, allowing the pushing members 9A, 9B to be displaced and the selected mandrels thus to be transferred into the housings 18.

In a similar manner to the means 12, 12' for aiding the positioning of the abutment members 6, 6', the element 25 is positioned above the element 25' and the teeth of the element 25 are offset axially with respect to the teeth of the element 25' and set back from them with respect to the supply groove 2.

The pairs of pushing members 9A, 9B can preferably be displaced simultaneously in order to transfer at the same time and hence quickly all the selected mandrels 1' into the individual housings 18.

Each pushing member 9A, 9B in the form of a pin comprises a part 27 in the shape of an inverted U that allows the pin to fit over a guide rod (not shown) parallel to the grooves, extending transversely to said rod. Such a design of the pin and the use of the guide rod make it possible to maintain the orthogonal orientation of the pin relative to the axes of the grooves 2, 3. The unit formed by the pins 9A, 9B, the guide rod and the elements 25, 25' can be moved radially relative to the axes of the grooves 2, 3.

The pushing members 9A, 9B can thus be positioned accurately opposite the selected mandrels 1' in order to transfer said mandrels accurately into the housings. As a variant, it can be provided that the relative positions of the pushing members cannot be adjusted. Subsequently, when the length of the mandrels varies from one preparation cycle to another, the transfer means must be replaced by other transfer means, the pushing members of which correspond to the positions of the selected mandrels, i.e. the mandrels to be transferred.

Figure 3:
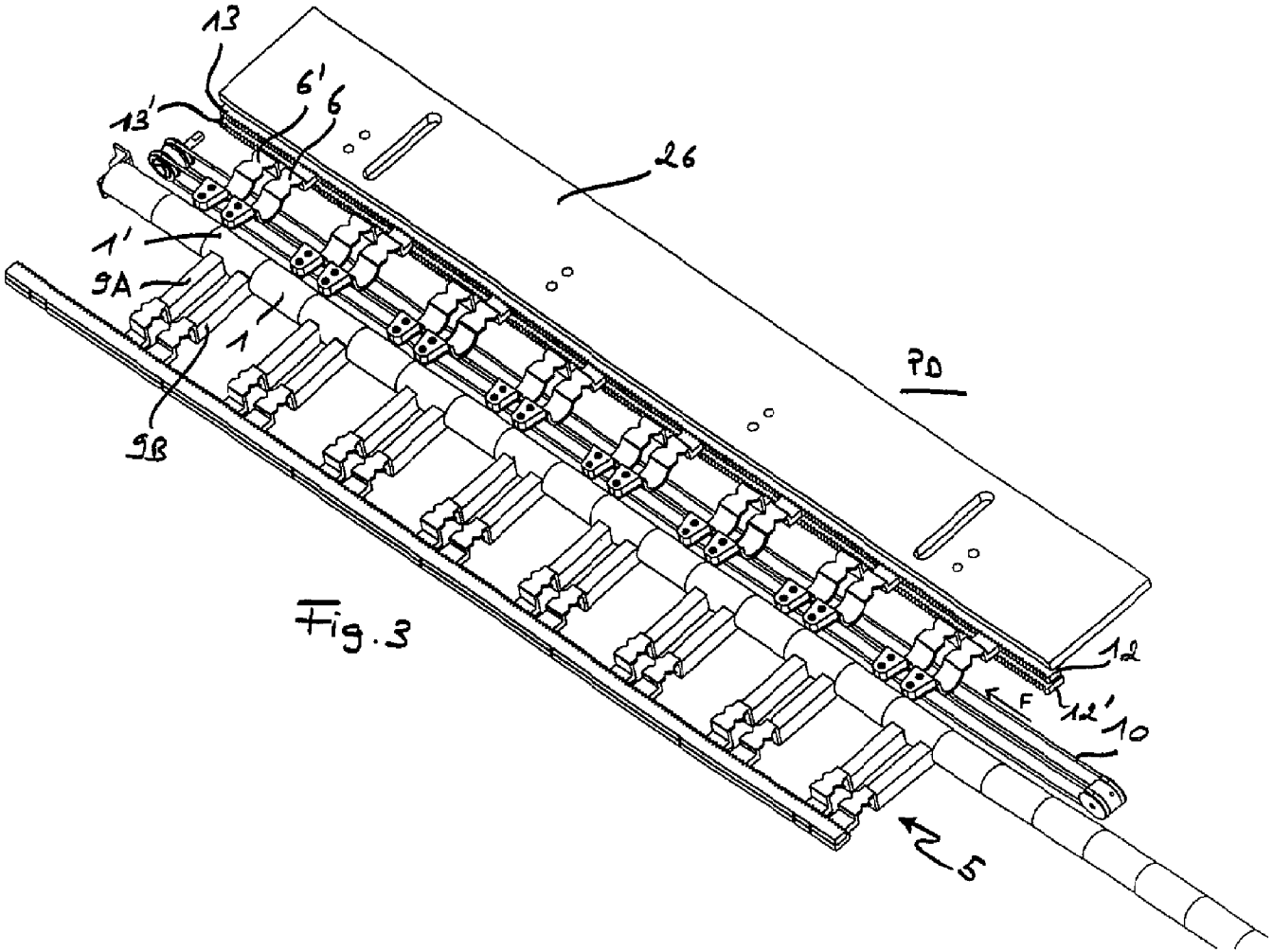
FIG. 3 is a perspective view of the preparation device according to the invention, the mandrels being aligned in the supply groove.

The device can also comprise an element 26, or cover, for covering the mandrels 1' housed in the receiving groove 3, such as a plate. Said covering element 26 can be displaced between a position CP (FIG. 5) in which it covers at least partially said groove 3 in order to hold said mandrels 1' inside the receiving groove 3 (in particular when the rod is fitted into the mandrels) and a position UP in which said groove 3 is uncovered (FIG. 3).

Device for Collecting Full Mandrels

Figure 7:
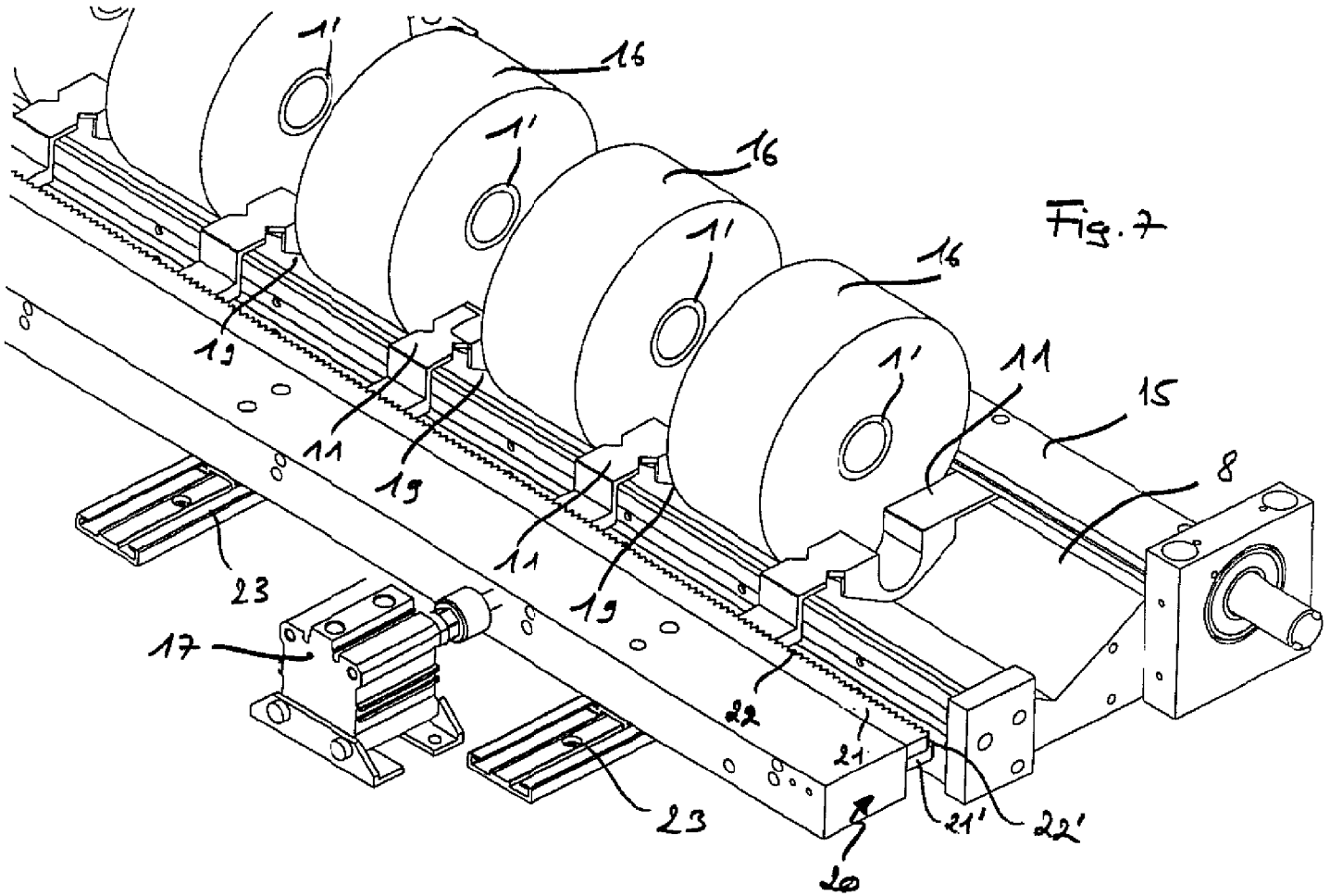
FIG. 7 is a perspective view of the device for collecting the reels.
Figure 8:
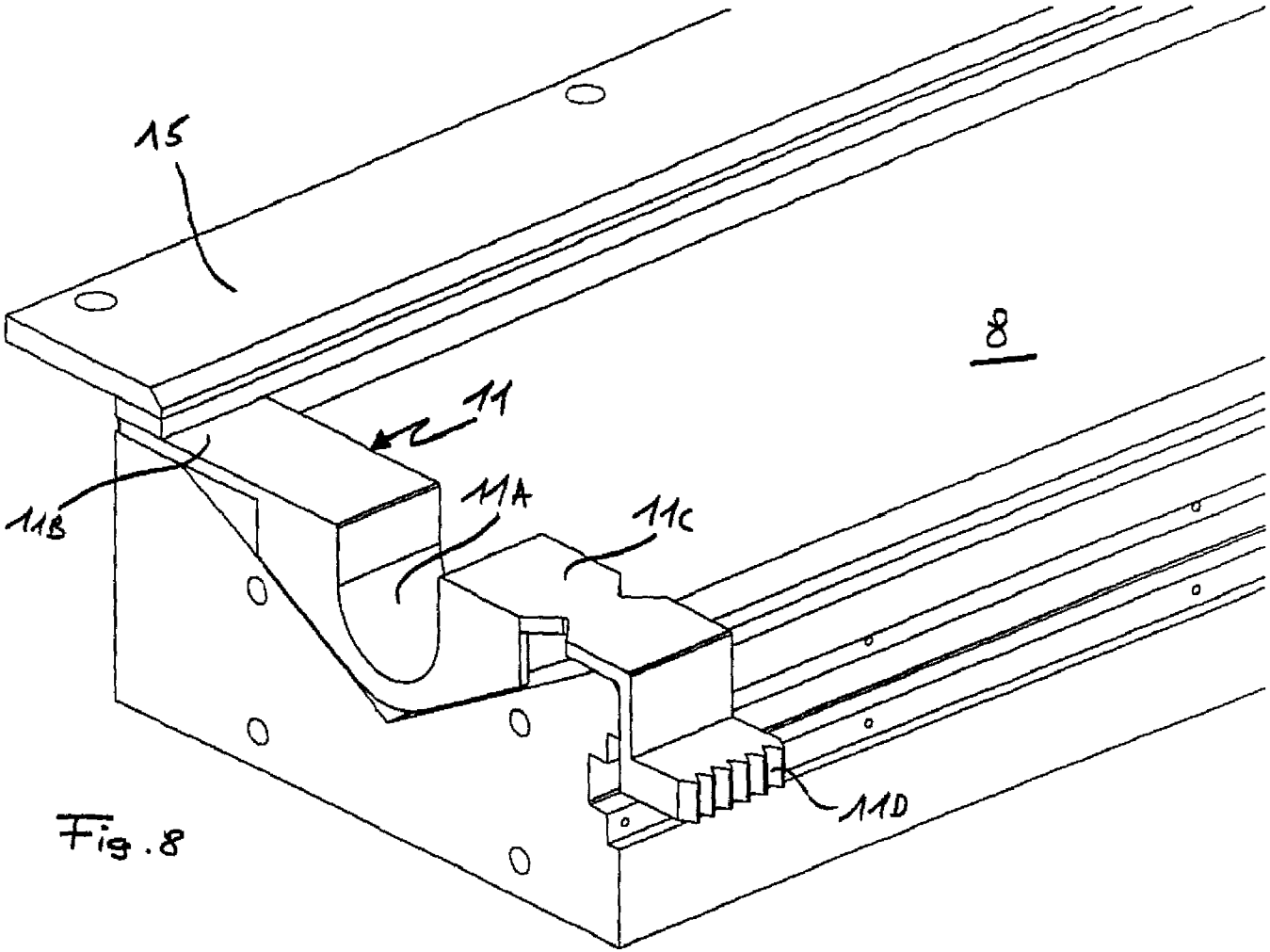
FIG. 8 is a detailed perspective view of a reel abutment member arranged in the groove of the collecting device in FIG. 7.
Figure 9:
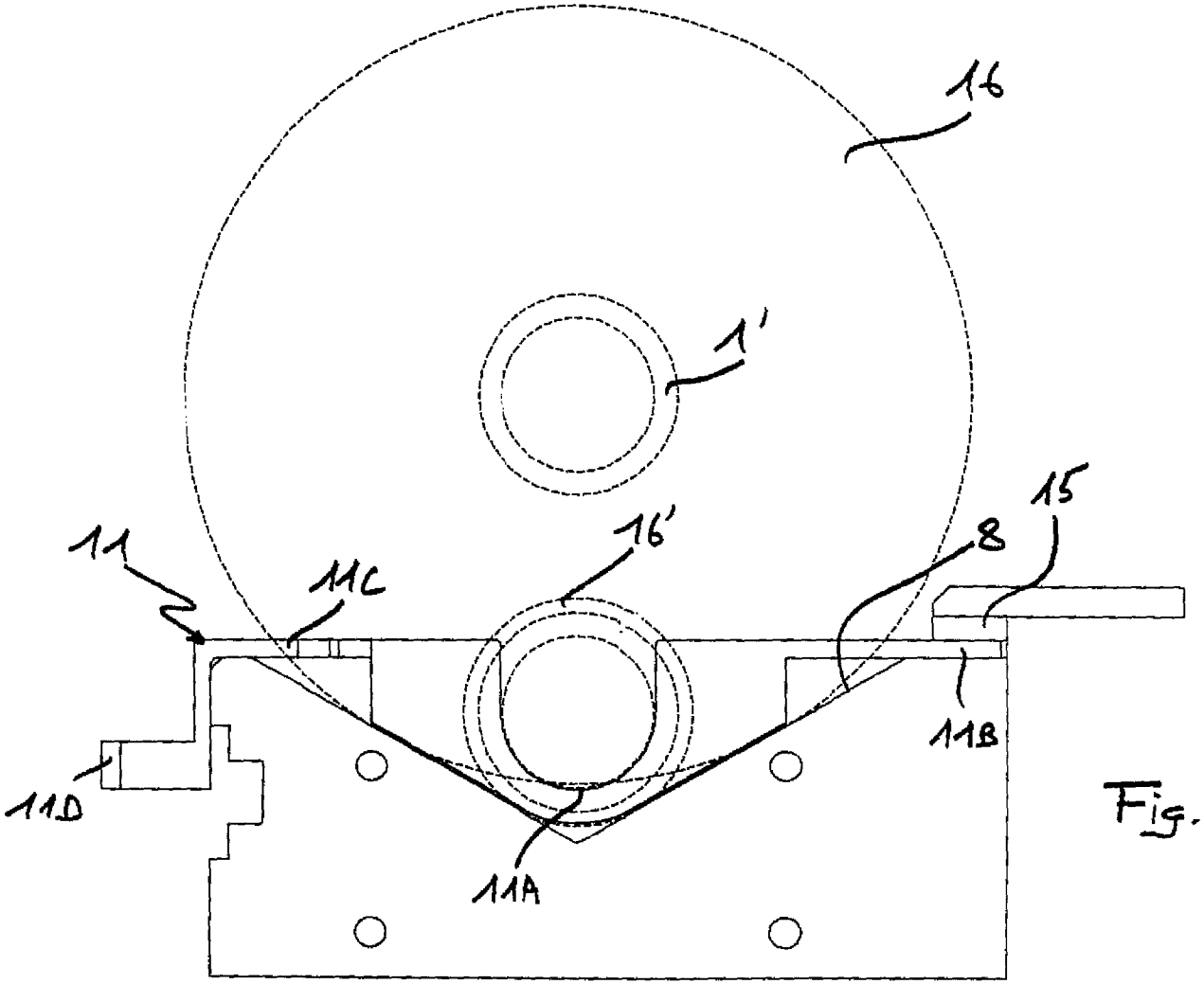
FIG. 9 is a cross-sectional view of the groove of the collecting device and of the abutment member in FIG. 8.

As illustrated in FIGS. 7 to 9, said collecting device comprises a groove 8 for receiving the reels in individual reel housings 19 defined by axial abutment members 11. The position of each abutment member 11 can be adjusted along said reel-receiving groove 8 in order to define said individual housings 19 for reels 16. Said individual housings 19 have substantially the same axial length as the individual housings 18 of the receiving groove 3 of said preparation device. As illustrated in FIG. 9, the groove 8 comprises a V-shaped section which allows reels 16, 16' of different diameters to be collected.

In a similar manner to the preparation device, the collecting device comprises means 20 for aiding the positioning of the abutment members 11 for the reels along the axis of the reel-receiving groove 8. The means 20 for aiding the positioning comprise two elements 21, 21' which extend parallel to the axis of the reel-receiving groove 8 and are equipped with teeth 22, 22', in the manner of a rack, capable of interacting with teeth 11D arranged at one end of each of the abutment members 11 positioned along the axis of the reel-receiving groove 8.

In a similar manner to the means 12 and 24 for aiding the positioning of the abutment members and the pushing members, the element 21 is positioned above the element 21' and the teeth 22 of the element 21 are set back from the teeth 22 of the element 21 with respect to the axis of the groove 8 and are also offset axially with respect to the teeth 22' of the element 21'. Such a geometric configuration of the two elongated elements 21, 21' and their teeth 22, 22' makes it possible to position a reel abutment member 11 by precise steps (in this case, one millimeter) corresponding to half the gap between two teeth of a same element.

The two superposed longitudinal elements 21, 21' are mounted in sliding fashion on rails 23 so that they can be displaced transversely to the axis of the reel-receiving groove 8 so as to eliminate the play between the teeth 22, 22' of the elements 21 and 21' and the teeth of the abutment members 11. Such transverse displacement can be effected with an actuator system 17 as illustrated in FIG. 7.

As illustrated in FIG. 8, each abutment member 11 comprises a central part 11A, one side of which serves as an axial abutment with respect to an adjacent reel 16. The central part 11A has a notch that permits the passage of the rod both for it to be deposited in the groove 8 with the reels and for it to be extracted from the reels. This central part 11A is extended on one side by a straight end part 11B which comes to bear against a longitudinal edge of the groove 8. The other side of the central part 11A is extended by another part 11C in the shape of an inverted U which comes to bear on the other lateral edge of the groove and terminates in end teeth 11D capable of interacting with the teeth 22 and 22' of the elements 21, 21' of the means 20 for aiding positioning. As can be seen in FIG. 8, the parts 11A, 11B, 11C and 11D are advantageously aligned.

The collecting device furthermore comprises means 15 for holding in position the abutment members 11 for the reels in the reel-receiving groove 8. These holding means 15 are here formed by a clamping plate that allows the end part 11B of each abutment member 11 to be held against a longitudinal edge of the groove 8.

Method for Handling the Mandrels

The method for handling the mandrels with the aid of the above-described handling device comprises the following main steps:

a) positioning, along the groove 3 for receiving the mandrels 1', abutment members 6 for defining the individual housings 18 for receiving the mandrels 1' to be fitted, each abutment member 6 being positioned as a function of the desired position of said mandrels on the rod 7, b) bringing a series of aligned and juxtaposed mandrels 1 into the supply groove 2 arranged in proximity to the receiving groove 3, the order of steps a) and b) being interchangeable, c) transferring, preferably simultaneously, the selected mandrels 1' to be fitted from the supply groove 2 to the receiving groove 3, into said individual mandrel housings 18, d) possible axial displacement of the mandrels 1' transferred into the individual housings 18 of the receiving groove 3 in order to bring them into abutment with the abutment members 6.

e) treading the rod 7 into the hollow axis of the empty mandrels 1', and then inserting the rod equipped with the bare mandrels 1' into the winding machine, f) winding of the mandrels 1' fitted onto the rod 7 to form reels 16, g) depositing the reels carried by the rod 7 in the individual reel housings 19 defined by abutment members 11 positioned beforehand in a receiving groove 8 for the reels, h) removal of the rod 7 by axial displacement of the reels, said reels remaining in place in said individual reel housings 19.

i) packing of the full mandrels or reels.

Before steps a) or b), the number of the abutment members 6 to be positioned in the receiving groove 3, and their axial position along said groove 3 are preferably determined at least as a function of the length and/or the number of mandrels 1 to be mounted on the rod 7.

The steps of the handling method are detailed below.

The abutment members are positioned in the receiving groove 3 so as to define the individual housings 18 for the mandrels as a function of desired positions of the mandrels on the rod. The position along the groove 3 of the side of the part 6A of a member 6 forming an axial abutment corresponds to the desired position of the end face of a mandrel on the rod.

It can be provided that the abutment members 6, 6' are arranged manually by the operator in the receiving groove 3 or automatically with the aid of the electronic and data-processing management unit and the automatic positioning device controlled by the said unit in order to place the abutment members in their position determined by the determination means, along the receiving groove 3.

As illustrated in FIG. 1, it is possible to pair each abutment member 6 with another abutment member 6'. Of course only one of the abutment members 6 serves as an axial abutment with respect to a selected mandrel. The use of a pair of abutment members 6 serves to form two radial abutments with respect to an unselected mandrel 1 intended to remain in the supply groove 2 during the transfer of the selected mandrels, in order to hold it in the supply groove 2.

The precise positioning of the abutment members 6, 6' is achieved by the means 14 for aiding the positioning as described above. Depending on whether the determined position of a mandrel along the groove 3 can be obtained by interaction of the teeth of an abutment member 6, 6' with the teeth 13 of the upper element 12 or those 13' of the lower element 12', the operator or the robot selects the corresponding abutment member 6 or 6' and brings it into engagement with the teeth of the associated element 12 or 12'.

The abutment members 6, 6' are brought into position from the top of the receiving groove 3 to engage with the teeth 13, 13' of the elements 12, 12'. Once the abutment members have been positioned along the groove 3, the elements 12, 12' are displaced radially to eliminate the residual play between the teeth 13, 13' of the elements 12, 12' and those of the abutment members 6, 6'. The abutment members 6, 6' are then immobilized axially in their desired position in the groove.

The bare mandrels are advanced and grouped together, one behind the other, in the direction of their axis in the supply groove 2 by a conveying device (not shown).

The conveying device continues to be activated whilst the mandrels 1 are retained by the abutment 4. As a result, the mandrels arranged in the supply groove 2 are pushed up against one another, which makes it possible to obtain a line of aligned mandrels juxtaposed by their end faces. As the position of the abutment 4 and the length of each of the mandrels are known, the position of each mandrel along the supply groove 2 is also known.

This conveying device associated with the supply groove (not shown) comprises, for example, in a similar manner to the conveying device 10 associated with the receiving groove 3 (visible in FIG. 1), two parallel endless loops formed by belts on which the mandrels 1 rest. The belts run inside and along the corresponding groove in order to displace the mandrels 1 along it.

The pushing members 9A, 9B of the transfer means 5 are positioned opposite the mandrels 1' selected to be transferred into individual housings 18. The selected mandrels 1' correspond to the mandrels of the supply groove 2, the relative positions of which correspond substantially to the desired relative mutual positions of the mandrels on the rod 7. Thus, in the example illustrated in the figures, the so-called selected mandrels are those arranged opposite the individual housings 18.

As illustrated in FIG. 3, the cover 26 is initially in a covered position to allow the mandrels 1 to be transferred into the individual housing 18 formed between adjacent pairs of members 6 and 6'.

Figure 4:
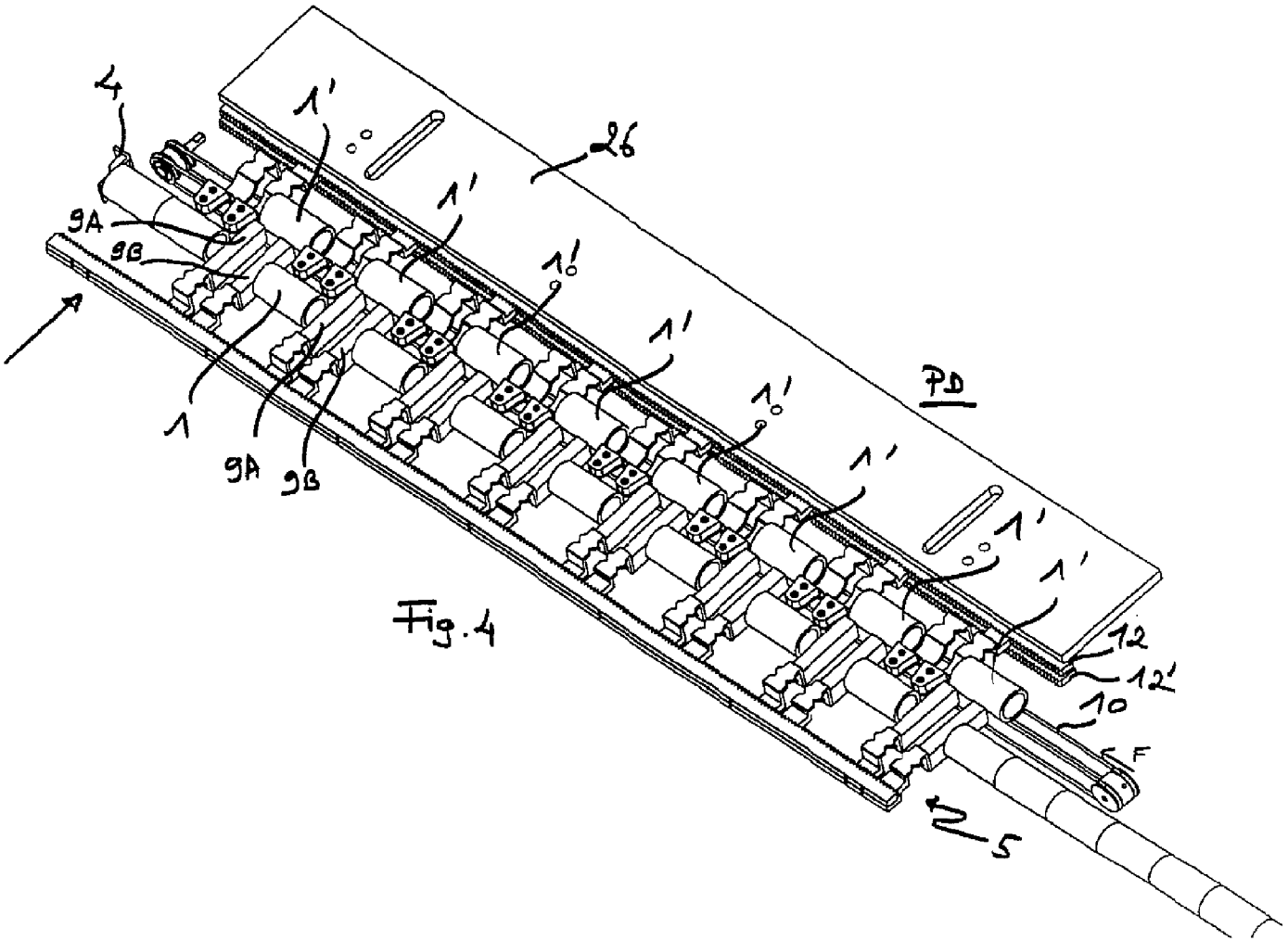
FIG. 4 is a perspective view of the preparation device in FIG. 3 during the transfer of the selected mandrels toward the receiving groove.
Figure 5:
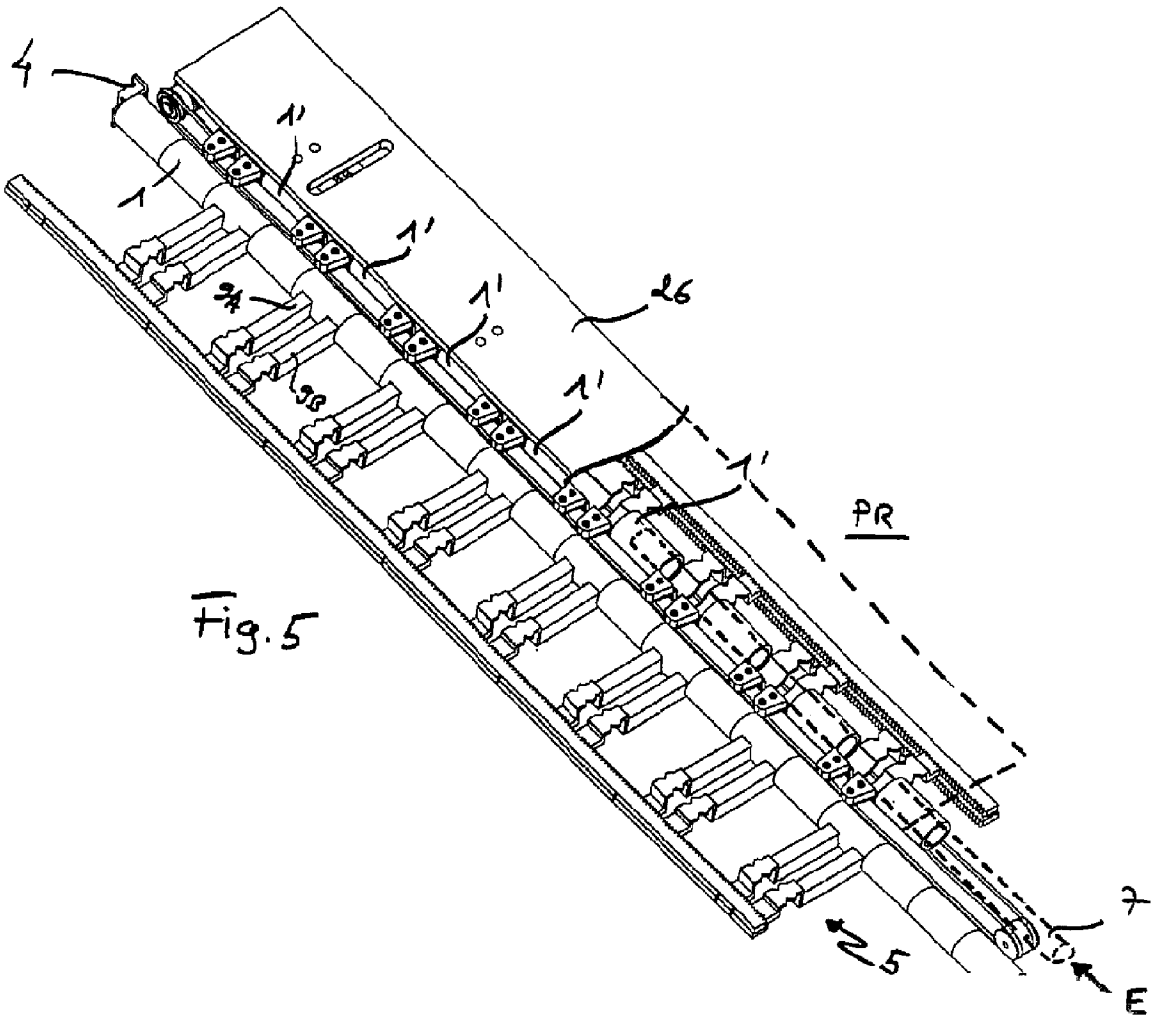
FIG. 5 is a perspective view of the preparation device in FIG. 4 during the fitting of the rod inside the mandrels.

As illustrated in FIG. 4, the selected mandrels are pushed by the pushing members 9A, 9B into the housings 18 of the receiving groove 3. To do this, the pushing members 9A, 9B are simultaneously displaced radially relative to the axis of the groove 2 until they are at right angles to the receiving groove 3, so that the pushed mandrels take their places in the corresponding individual housings 18. In the example illustrated in FIG. 4, every other mandrel is displaced into the receiving groove 3.

The supply groove 2 is preferably raised relative to the receiving groove 3 so as to permit easy transfer of the mandrels toward the housings 18.

As illustrated in FIG. 4, at the end of their pushing movement, the pushing members 9A, 9B extend transversely above the supply groove 2 and their ends fit between the parts 6B and 6E of two adjacent pairs of members 6, 6'. Owing to the presence of the parts 6B and 6E that form an abutment, the unselected mandrels are not carried along and remain in the supply groove 2.

Once the mandrels 1' have been pushed into the individual housings 18, the pushing members 9A, 9B are retracted, which allows the supply groove 2 to be freed and all the unselected mandrels 1 to be grouped together against the abutment 4 to form a new alignment of juxtaposed mandrels and complete the alignment with other mandrels so as to prepare a new cycle of fitting mandrels onto a rod.

The mandrels 1' transferred into the housings 18 are then brought by a displacement in the direction of arrow F, by the conveying device 10 into abutment with the side of the corresponding abutment members 6 in order to reach their precise desired position.

The cover 26 then covers the mandrels 1' to hold them in place. One of the ends of the rod 7 is then fitted into the hollow axis of the mandrels positioned in the receiving groove 3. In particular, the rod 7 is fitted into one end of the receiving groove 3 (in this case, the right-hand end as illustrated by arrow E in FIG. 5), in the same direction as the direction (arrow F) in which the mandrels 1' were displaced to abut against the sides of the abutment members 6. As a variant, it is also possible to reverse the direction of displacement imparted by the conveying device 10 to the selected mandrels (opposite direction to arrow F). In this case, said mandrels would be brought into abutment 6' and the fitting of the rod would be effected via the other end of the guarantee 3 (on the left in FIG. 5, in the opposite direction to arrow E).

Owing to the shape of the central part 6A of each abutment member permitting the passage of the rod 7, the rod can easily be fitted in the direction of the axis of the mandrels 1', the latter maintaining their relative positions by virtue of the axial abutments of said abutment members 6. Once the rod 7 has been fitted into the mandrels, the cover 26 is lifted up to free the receiving groove and allow the rod equipped with the bare mandrels to be removed from above. The shape (open at the top) of the central part 6A of each abutment member facilitates the extraction of the rod from above.

Figure 6:
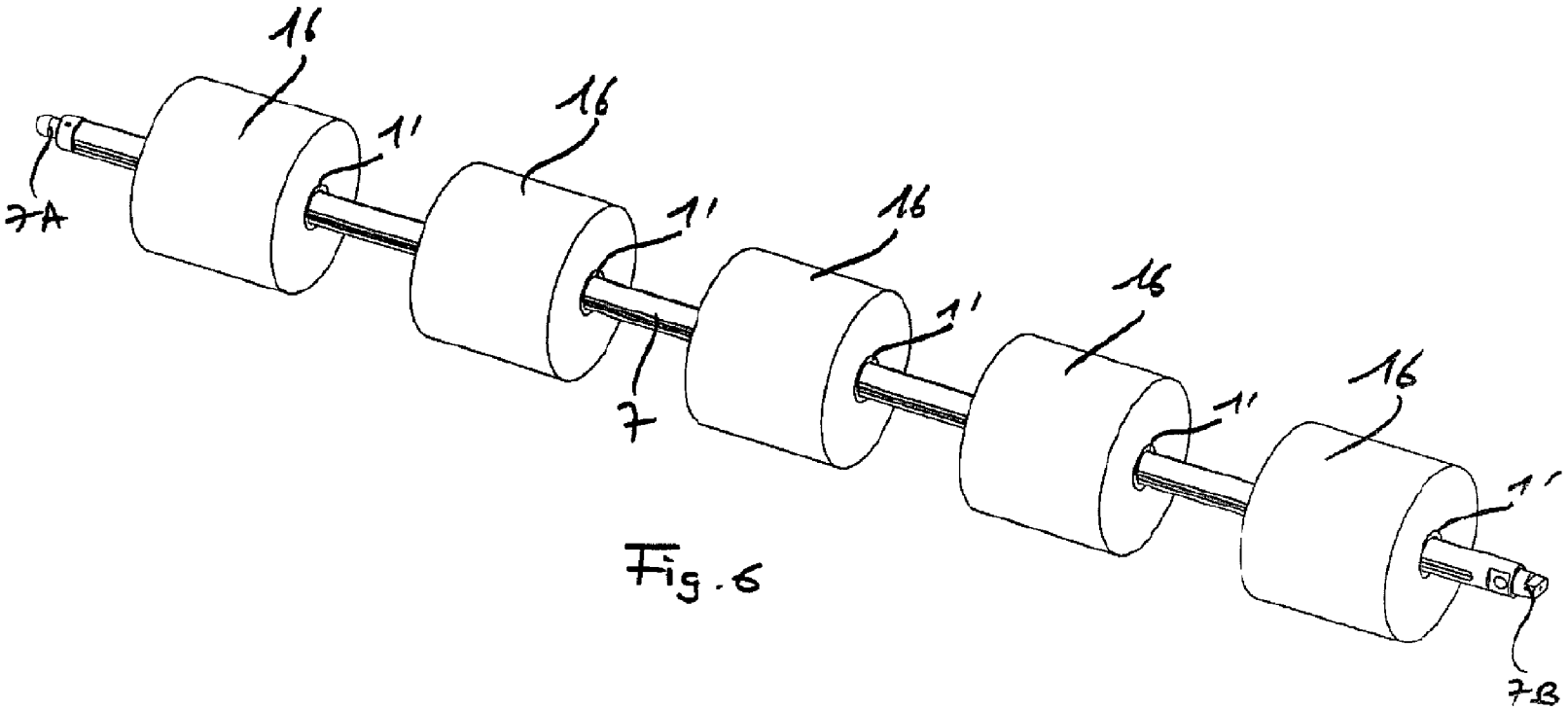
FIG. 6 is a perspective view of the rod equipped with the mandrels after said mandrels have been wound.

As illustrated in FIG. 6, each rod is equipped at its ends 7A, 7B with geometric shapes which allow it to be grasped and manipulated. The rod can be manipulated manually or by a robot equipped with grasping means whose shape matches that of the ends of the rod.

Once the mandrels 1' have been fitted onto the rod, they are held in position on the said rod 7 with the aid of holding means such as a system formed of rubber studs which can be displaced so that they project radially from the rod by injecting compressed air inside the rod, which is hollow in this example. When the compressed air is injected, the studs come to bear against the internal peripheral wall of the mandrels, and in this way hold said mandrels in position on the rod.

The rod 7 provided with the empty mandrels 1' held in their desired position first passes in front of a device for capturing images (not shown), such as a camera, associated with image-processing software to check that the positions of the mandrels along said rod correspond properly to the desired positions, and then is inserted into the winding machine (not shown). The mandrels are then filled, in other words wound, simultaneously by rolling a tape, in this case a heat transfer tape, around them. Once the winding is complete, the robot or the operator withdraws the rod from said winding machine. As illustrated in FIG. 6, the mandrels are covered with a roll of heat transfer tape. Each full mandrel forms a reel 16.

The rod equipped with the reels 16 is then placed in the collecting device (FIG. 7) either by the operator or by the automatic positioning device controlled by the electronic and data-processing unit. Prior to the placing of the rod 7 in the collecting device, the abutment members 11 have been positioned in the receiving groove 8 to form individual housings 19 for receiving the reels, the length of which housings is substantially equal to the length of the corresponding housings 18 for the mandrels. As mentioned above, said abutment members 11 are associated with means 20 for aiding the positioning, similar to the other means for aiding the positioning, formed by two superposed longitudinal elements 21, 21' equipped with teeth 22, 22' which interact with teeth of the abutment members 11.

The means for holding the reels on the rod are then deactivated, for example by releasing the compressed air inside the rod, which allows the studs to be retracted inside said rod so as to permit the mandrels to slide on the rod. The rod 7 is then extracted by pulling it along its axis, whilst the reels are held in their housing between the abutment members 11, abutting the latter. An automatic or non-automatic gripping device can then grasp the reels individually in their housings to store them in containers.

For a new mandrel winding cycle, the new positions of the abutment members and the pushing members are adjusted, if necessary, as a function of the length of the mandrels and of their desired position on the rod.

The present invention is in no way limited to the embodiment described and illustrated, and a person skilled in the art will be able to produce alternative embodiments that conform with the spirit of the invention.

The invention claimed is:

1. A device for preparing a set of mandrels (1') to be fitted onto a rod (7) and spaced apart from one another, comprising at least two grooves (2, 3) arranged in proximity to one another, namely:

a supply groove (2) for receiving the mandrels (1) aligned along the axis of said supply groove (2) and juxtaposed via their end face, said supply groove (2) being associated with means for juxtaposing said aligned mandrels (1), the means for juxtaposing the mandrels (1) arranged in the supply groove (2) comprising a unit for conveying the mandrels along the supply groove (2), said unit being associated with an abutment (4) at one end of the supply groove (2) for immobilizing axially the mandrels (1) aligned in said supply groove (2) in a juxtaposed position, and a receiving groove (3) for receiving mandrels (1') selected from the aligned mandrels (1) the supply groove (2), said receiving groove (3) being equipped with abutment members (6) that can be positioned in said receiving groove (3) along the axis of said receiving groove (3) in order to define individual housings (18) for receiving the selected mandrels (1'), the device also comprising means (5) for transferring the selected mandrels (1') from the supply groove (2) toward said individual receiving housings (18).

2. The device as claimed in claim 1, further comprising means for determining the position at which each abutment member (6) must be arranged along the receiving groove (3) in order to form said individual housings (18) for receiving the selected mandrels, each position being determined at least as a function of the length and/or the number of the mandrels to be mounted on the rod (7).

3. The device as claimed in claim 1, wherein the receiving groove (3) is equipped with a device (10) for axially displacing the received mandrels (1') in order to bring them into abutment, within the receiving groove (3), with the corresponding abutment members (6) positioned in said receiving groove.

4. The device as claimed in claim 1, wherein said means (5) for transferring the selected mandrels (1') comprise radial pushing members (9A, 9B) that are intended to be brought to bear, via a pushing end, against the peripheral wall of the selected mandrels (1'), said pushing members (9A, 9B) being moveable between a starting position in which said members are retracted from the supply groove (2) and a final position in which the pushing end of said members is arranged at right angles to the receiving groove (3), the position of each pushing member (9A, 9B) being axially adjustable with reference to the selected mandrels (1') to be transferred.

5. The device as claimed in claim 1, further comprising means (14) for aiding the positioning of the abutment members (6) along the axis of the receiving groove (3).

6. The device as claimed in claim 5, wherein the means (14) for aiding the positioning comprise at least one element (12) that extends parallel to the axis of the receiving groove (3) and is equipped with teeth (13), in the manner of a rack, that can interact with corresponding teeth (6D) arranged on the distal end of each of the abutment members (6) positioned along the axis of the receiving groove (3).

7. The device as claimed in claim 1, wherein each axial abutment member (6) positioned along the axis of the receiving groove (3) extends substantially perpendicularly to the supply groove (2) to form a radial abutment for the unselected mandrels, so that said unselected mandrels are retained in the supply groove (2).

8. The device as claimed in claim 1, further comprising at least one element (26) for covering the mandrels (1') housed in the receiving groove (3), said at least one covering element (26) being displaceable between a first position (CP) in which said at least one covering element at least partially covers said receiving groove (3) in order to hold said mandrels (1') inside the receiving groove (3) and a second position (UP) in which said receiving groove (3) is uncovered.

9. A device for handling mandrels, comprising a preparation device for preparing empty mandrels according to claim 1 with a view to them being fitted onto a rod, and a collecting device for collecting full mandrels known as reels (16) and carried by the rod (7) with a view to them being removed from the rod, said collecting device comprising a V-shaped groove (8) for receiving the reels in individual housings (19) for reels defined by axial abutment members (11), the position of each abutment member (11) being adjustable along said reel-receiving groove (8) in order to define said individual housings (19) for reels (16), with an axial length substantially equal to that of the individual housings (18) for mandrels (1) of the receiving groove (3) of said preparation device.

10. The device as claimed in claim 9, further comprising means (15) for holding the abutment members (11) for the reels in position in the receiving groove (8) for the reels.

11. The device as claimed in claim 9, further comprising means (20) for aiding the positioning of the abutment members (11) of the reels along the axis of the receiving groove (8) for the reels.

12. The device as claimed in claim 11, wherein the means (20) for aiding the positioning comprise at least one element (21) that extends parallel to the axis of the receiving groove (8) of the reels and is equipped with teeth (22), in the manner of a rack, that can interact with corresponding teeth (11D) arranged on each of the abutment members (11) positioned along the axis of the receiving groove (8) for the reels.

13. The device as claimed in claim 9, further comprising means for checking the positioning of each mandrel (1') along the rod (7), the checking means comprising a device for capturing images, and image-processing software.

14. A method for preparing mandrels (1') to be fitted on a rod (7) and spaced apart from one another, which comprises the steps of:

a) positioning, along a groove (3) for receiving the mandrels (1'), abutment members (6) for defining individual housings (18) for receiving the mandrels (1') to be fitted, each abutment member (6) being positioned as a function of the desired position of said mandrels on the rod, b) bringing, via a conveying device, a series of aligned mandrels (1) juxtaposed via their end face into a supply groove (2) arranged in proximity to the receiving groove (3) for the mandrels, the order of steps a) and b) being interchangeable, c) transferring the mandrels (1') to be fitted from the supply groove (2) toward the receiving groove (3), into said individual mandrel housings (18), and d) axially displacing the mandrels (1') transferred into the individual housings (18) of the receiving groove (3) in order to bring them into abutment with the abutment members (6).

15. The method as claimed in claim 14, wherein before steps a) or b), the number of the abutment members (6) to be positioned in the receiving groove (3) and their axial position along said groove (3) are determined at least as a function of the length and/or the number of mandrels (1) to be mounted on the rod (7).

16. A method for handling mandrels (1) comprising the steps for preparing the empty mandrels as claimed in claim 14, further comprising the following steps of:

e) fitting empty mandrels (1'), housed in the receiving groove for the mandrels, onto a rod (7) and then transferring the rod into a winding area, f) winding onto the mandrels (1') fitted onto the rod (7) to form reels (16), g) depositing the reels carried by the rod (7) in individual reel housings (19) defined by abutment members (11) positioned beforehand in a receiving groove (8) for the reels, the position of each abutment member (11) being adjusted along said receiving groove (8) for the reels to define said individual housings (19) for the reels (16), and h) removing the rod (7) by axial displacement of the reels, said reels remaining in place in said individual reel housings (19).

17. A method for handling mandrels (1) comprising the steps for preparing the empty mandrels as claimed in claim 15, further comprising the following steps of:

e) fitting empty mandrels (1'), housed in the receiving groove for the mandrels, onto a rod (7) and then transferring the rod into a winding area, f) winding onto the mandrels (1') fitted onto the rod (7) to form reels (16), g) depositing the reels carried by the rod (7) in individual reel housings (19) defined by abutment members (11) positioned beforehand in a receiving groove (8) for the reels, the position of each abutment member (11) being adjusted along said receiving groove (8) for the reels to define said individual housings (19) for the reels (16), and h) removing the rod (7) by axial displacement of the reels, said reels remaining in place in said individual reel housings (19).

* * * * *